US005979671A

United States Patent [19]

Pan et al.

[11] Patent Number: 5,979,671

[45] Date of Patent: Nov. 9, 1999

[54] ELECTRICALLY OPERATED ELEVATABLE CLOTHES DRYING ASSEMBLY

[76] Inventors: Yang-Chang Pan; Te-Fu Yeh, both of 9th Fl., 143, Chung Shan Road., Linkow Hsiang, Taipei Hsien, Taiwan

[21] Appl. No.: 09/072,134

[22] Filed: May 5, 1998

[51] Int. Cl.[6] ..... A47F 5/00

[52] U.S. Cl. ..... 211/1.57; 211/117; 211/162; 248/328

[58] Field of Search ..... 211/1.57, 1.51, 211/117, 123, 162, 207; 248/327, 328, 329

[56] References Cited

U.S. PATENT DOCUMENTS

| | | | |
|---|---|---|---|
| 1,756,642 | 4/1930 | Horne | 211/117 X |
| 1,892,794 | 1/1933 | Wertzler | 211/117 X |
| 2,513,724 | 7/1950 | Hebanstreit | 211/117 X |
| 5,529,274 | 6/1996 | Anderson et al. | 248/329 |
| 5,676,259 | 10/1997 | Charchaflian et al. | 211/162 X |
| 5,695,072 | 12/1997 | Terragni | 211/1.51 |

*Primary Examiner*—Robert W. Gibson, Jr.
*Attorney, Agent, or Firm*—Rosenberg, Klein & Lee

[57] ABSTRACT

An electrically operated elevatable clothes drying assembly including two positioning frames having respective slide grooves for receiving respective slide blocks; a securing rod including a slide groove at an upper end for receiving the positioning blocks, a hollow extension extending downwardly form the slide groove, and a cylindrical tube formed at a lower end thereof, the cylindrical tube having a pair of positioning lugs at an inner edge thereof; left and right covers which are locked to the left and right ends of the securing rod to position a screw rod and a screw sleeve having curved indentations corresponding to the lugs of the cylindrical tube within the cylindrical tube, the covers further having pulleys corresponding to the hollow extension of the securing rod, and the right cover having an additional lower pulley; a clothes rod having a left rope passing over the pulleys of the covers to be secured to an upper end of the screw sleeve and a right rope passing over the lower pulley of the right cover to be secured to a lower end of the screw sleeve; and a motor and a control switch for driving and controlling rotation of the screw rod respectively.

3 Claims, 6 Drawing Sheets

ELECTRICALLY OPERATED ELEVATABLE CLOTHES DRYING ASSEMBLY

BACKGROUND OF THE INVENTION (a) Field of the Invention

The present invention relates generally to an electrically operated elevatable clothes drying assembly, and in particular to an elevatable clothes drying assembly operated by electricity to make clothes hanging and drying more convenient and safer.

(b) Description of the Prior Art

In the past, clothes along with their hangers are hung on a bamboo suspended at a high position of the verandah or balcony for drying purposes. This method is inconvenient and time consuming. An elevatable clothes drying assembly was later developed. In such known assembly, the clothes are hung on a rod or pole, which is pulled up by means of ropes. When the clothes are dry, the rod or pole is dropped by means of the ropes as well. Such manually operated clothes drying assembly has problems. When the clothes are wet, they are heavy, and pulling of the ropes is difficult. Besides, the ropes may easily get entangled.

SUMMARY OF THE INVENTION

A primary object of the present invention is to provide an electrically operated elevatable clothes drying assembly to eliminate the drawbacks of the prior art.

Another object of the present invention is to provide an electrically operated elevatable clothes drying assembly in which the height of a clothes rod may be set and adjusted.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
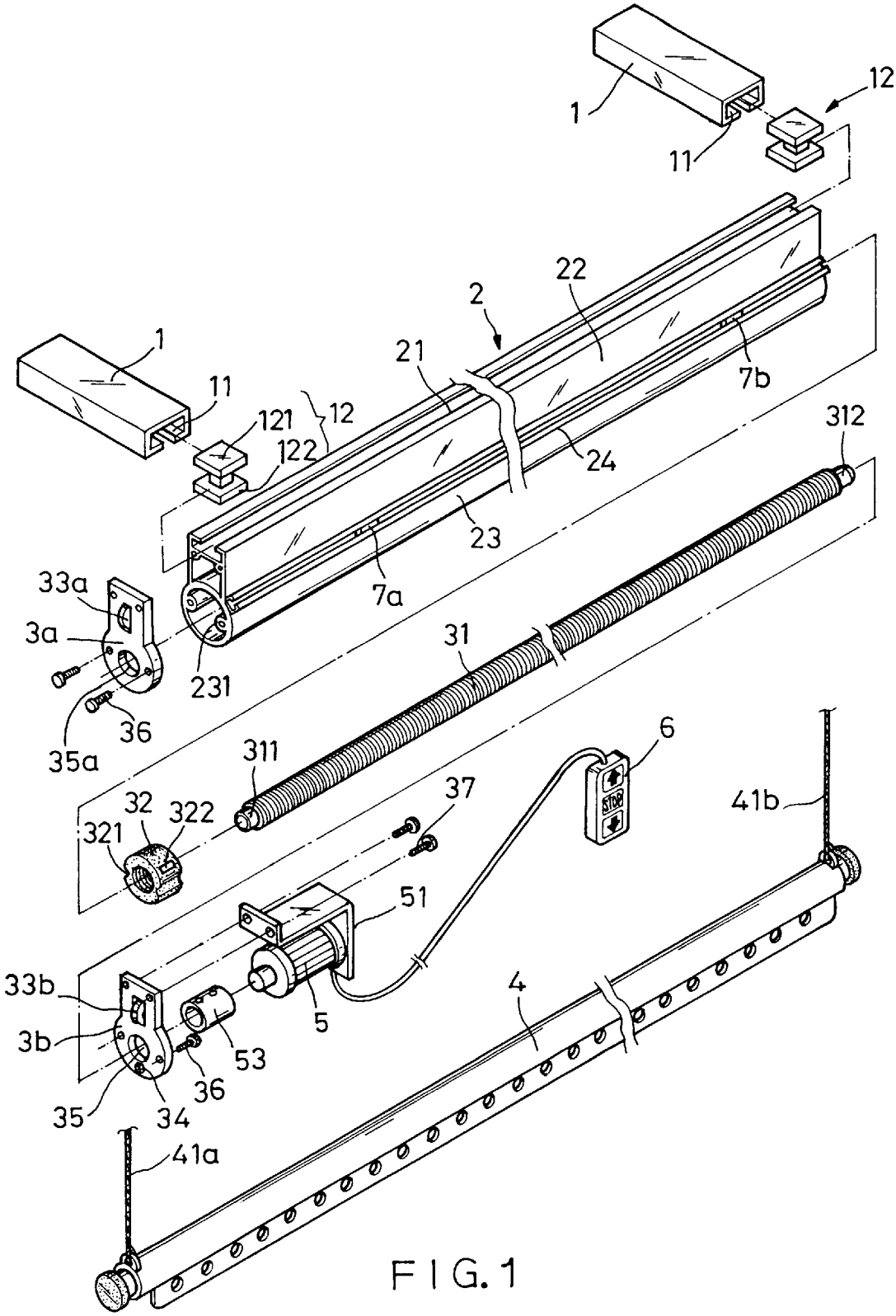
FIG. 1 is a perspective view of the present invention.

Referring to FIGS. 1–5, the electrically operated elevatable clothes drying assembly of the present invention comprises two positioning frames 1, locked to a ceiling 8 or a framework (not shown), and being provided with respective slide grooves 11 for receiving upper flanges 121 at upper ends of respective I-shaped positioning slide blocks 12; a securing rod 2 having a slide groove 21 formed at an upper end for receiving lower flanges 122 at lower ends of the positioning slide blocks 12, a hollow extension 22 extending downwardly from the slide groove 21, and a cylindrical tube 23 formed at a lower end thereof, the cylindrical tube 23 being provided with a pair of positioning lugs 231 at its inner edges; left and right covers 3*a* and 3*b*, locked to the left and right ends of the securing rod 2 respectively, a screw rod 31 being positioned in the cylindrical tube 23 by means of a screw sleeve 32 having a pair of curved indentations 321 matching the lugs 231 of the cylindrical tube 23, the covers 3*a* and 3*b* being further provided with respectively pulleys 33*a* and 33*b* to correspond to the hollow extension 22, the left cover 3*b* additionally having a lower pulley 34 at a lower end thereof; a clothes rod 4 including a left rope 41*a* having an upper end wound around the pulleys 33*a* and 33*b* of the left and right covers 3*a* and 3*b* before being fixed at an upper end of the screw sleeve 32, and a right rope 41*b* passing over the lower pulley 34 before being secured at a lower end of the screw sleeve 32; a motor 5 locked to one side of the right cover 3*b* by means of a securing plate 51 and being connected to the screw rod 31 for driving the screw rod 31 to rotate; and a control switch 6 for controlling the positive and reverse rotation of the motor 5 as well as the start and stop of the motor 5.

The electrically operated elevatable clothes drying assembly thus assembled makes clothes hanging and drying simpler and more convenient.

Furthermore, micro-switches LS1 and LS2 are respectively provided at both ends of the cylindrical tube 23 of the securing rod 2 and connected to the motor 5.

Figure 2:
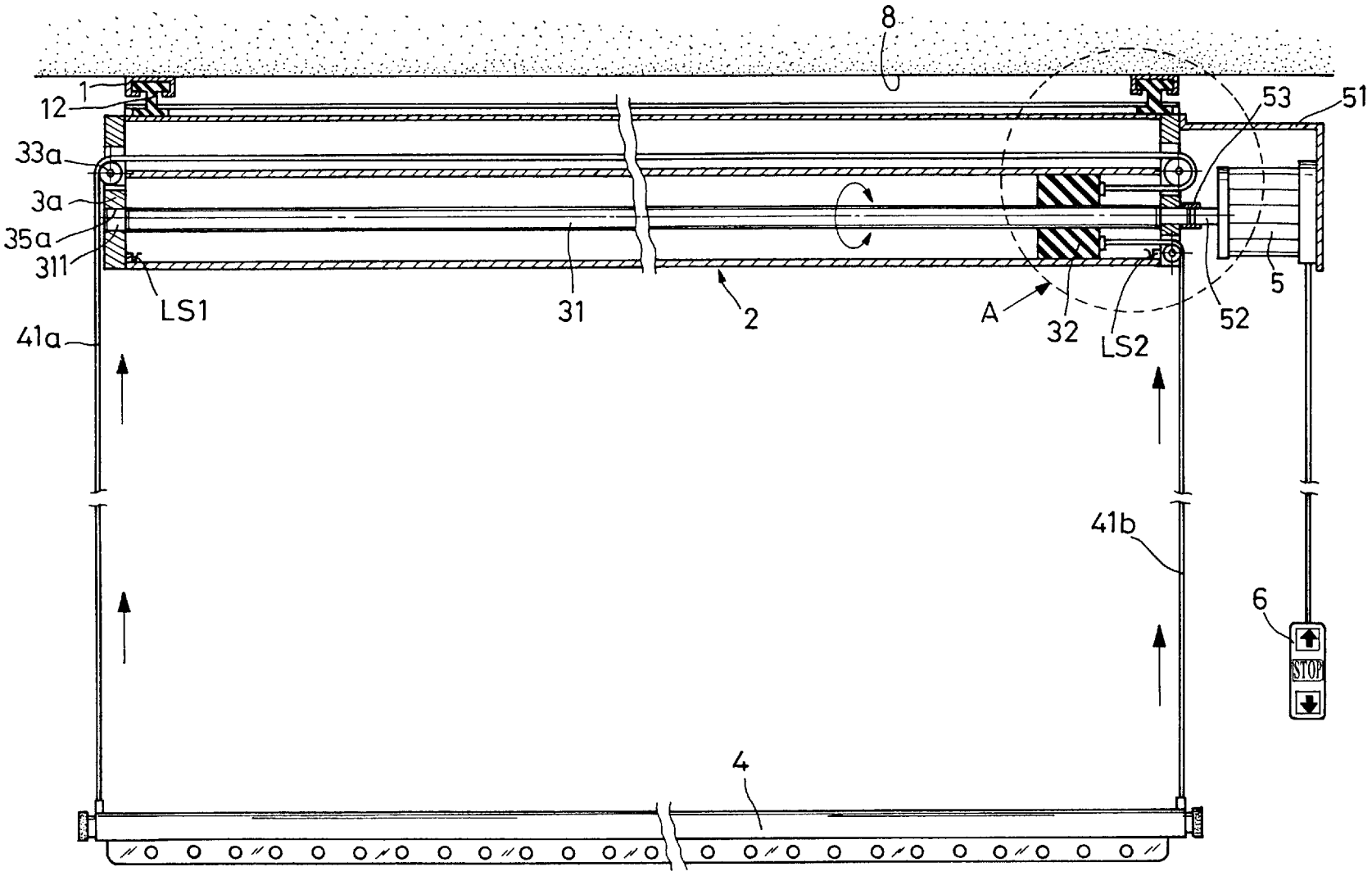
FIG. 2 is a sectional view of the present invention.
Figure 3:
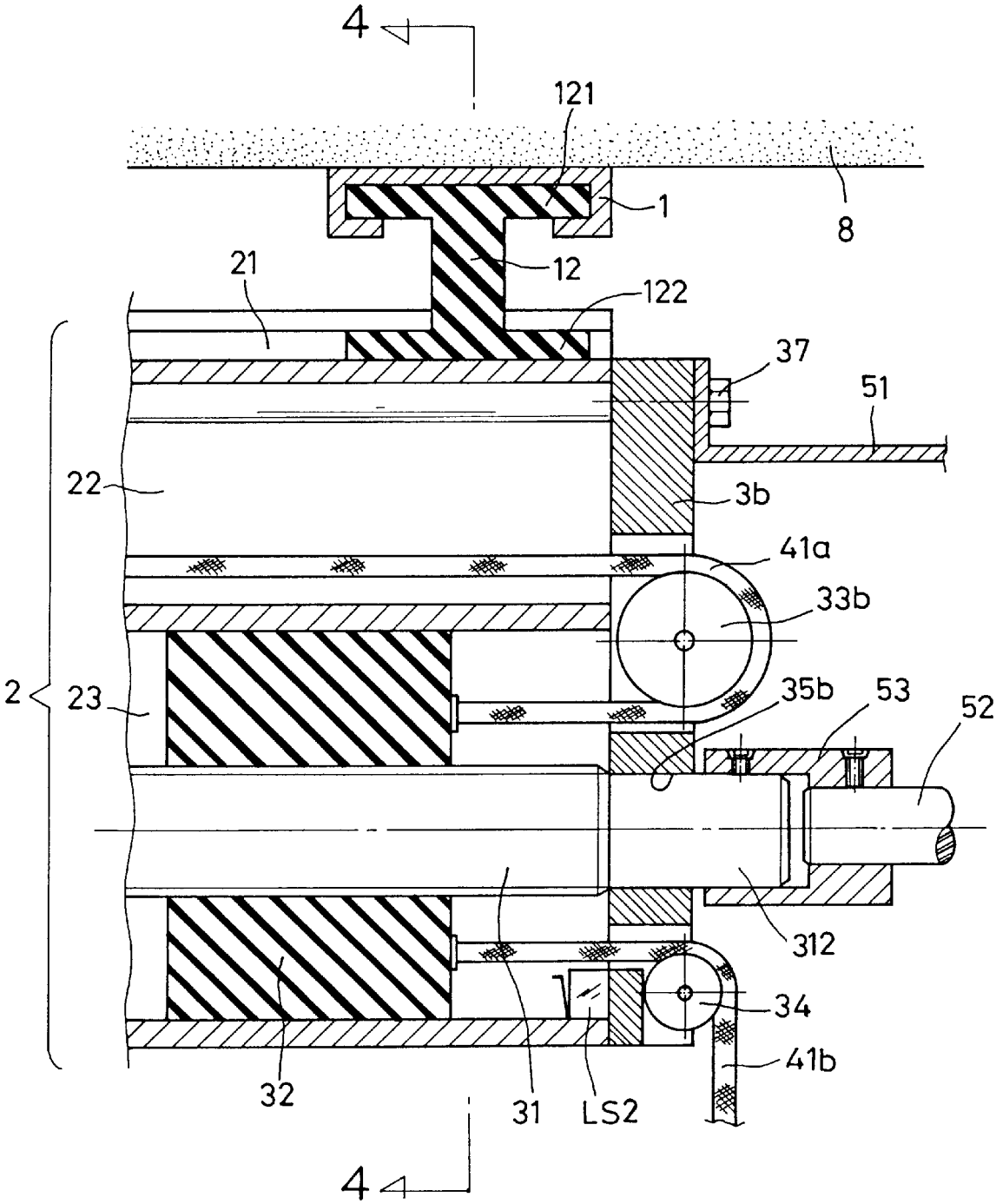
FIG. 3 is an enlarged view of the part A of FIG. 2.

Additionally, the left and right covers 3*a* and 3*b* are respectively provided with shaft holes 35*a* and 35*b* relative to the central position of the cylindrical tube 23 for positioning left and right shaft ends 311 and 312 of the screw rod 31. The left shaft end 312 is slightly longer and projects from the shaft hole 35*b* of the right cover 3*b*, and is further connected to an output shaft 52 of the motor 5 by a connecting sleeve 53, as shown in FIGS. 2 and 3.

Furthermore, as shown in FIG. 1, the left and right covers 3*a* and 3*b* are locked to the sides of the securing rod 2 by means of bolts 36.

After the screw rod 31 and its screw sleeve 32 as well as the left and right covers 3*a*, 3*b*, left and right ropes 4*a*, 4*b*, and the motor 5 have been assembled to the securing rod 2, the two positioning frames 1 are firstly locked to the ceiling 8 or a beam framework (not shown). Then, the positioning slide blocks 12 are used to connect the securing rod 2 to the positioning frames 2 so that the securing rod 2 is suspended.

When the motor 5 is actuated, the output shaft 52 brings the screw rod 31 to rotate. Since the screw sleeve 32 has curved indentations 321 matching the positioning lugs 231 of the cylindrical tube 23, the screw sleeve 32 will not rotate with the screw rod 31. Therefore, based on the principles of mechanics, the screw sleeve 32 will slidably displace along the cylindrical tube 23, thereby synchronously bringing the left and right ropes 4*a* and 4*b* to rise or fall and elevating or dropping the clothes rod 4 in a substantially level position.

Figure 5:
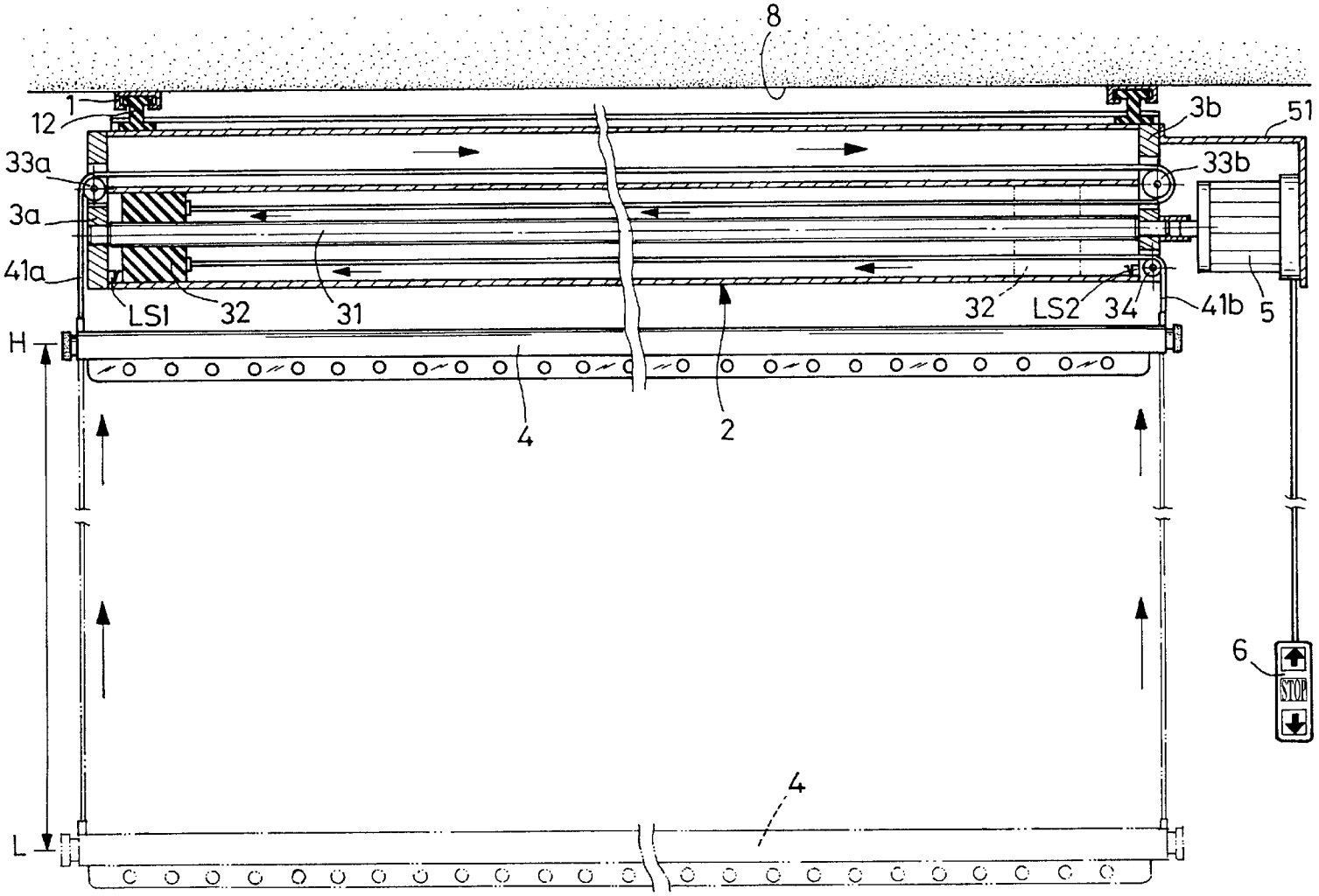
FIG. 5 is a schematic view illustrating operation of the present invention.

The operation of the motor 5 is controlled by buttons on the control switch 6. For example, by pressing a "↑" button, the motor 5 will rotate in a positive direction to drive the screw rod 31 to cause the screw sleeve 32 to displace to the left. The displacement of the screw sleeve 32 will synchronously bring the left and right ropes 4*a* and 4*b* to move therewith. Thus, the clothes rod 4 will, as shown in FIG. 5, rises from a lowest point L to a highest point H to elevate the clothes (not shown) to be dried. On the contrary, by pressing a "↓" button, the motor 5 will rotate in a reverse direction to drop the clothes rod 4. When the clothes rod 4 has elevated to the highest point H, the screw sleeve 32 displacing to the left will come into contact with the micro-switch LS1, and the motor 5 will be stopped. When the screw sleeve 32 displacing to the right contacts the micro-switch LS2, the clothes rod 4 will be dropped to the lowest point L. Certainly, a "STOP" button may be pressed to cause the clothes rod 4 to stop anywhere between the highest point H and the lowest point L.

Figure 4:
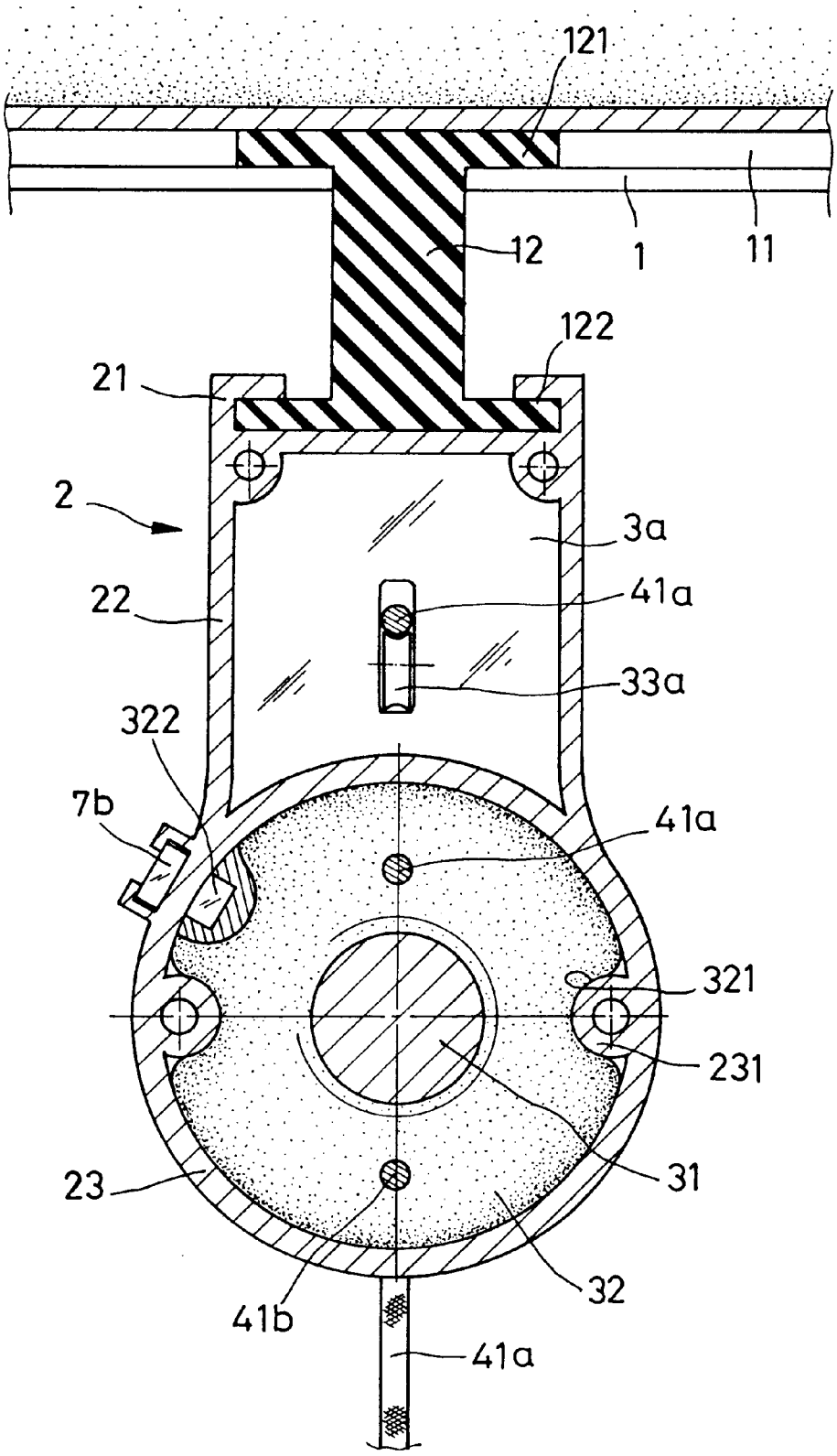
FIG. 4 is a sectional view taken along line 4—4 of FIG. 3.
Figure 6:
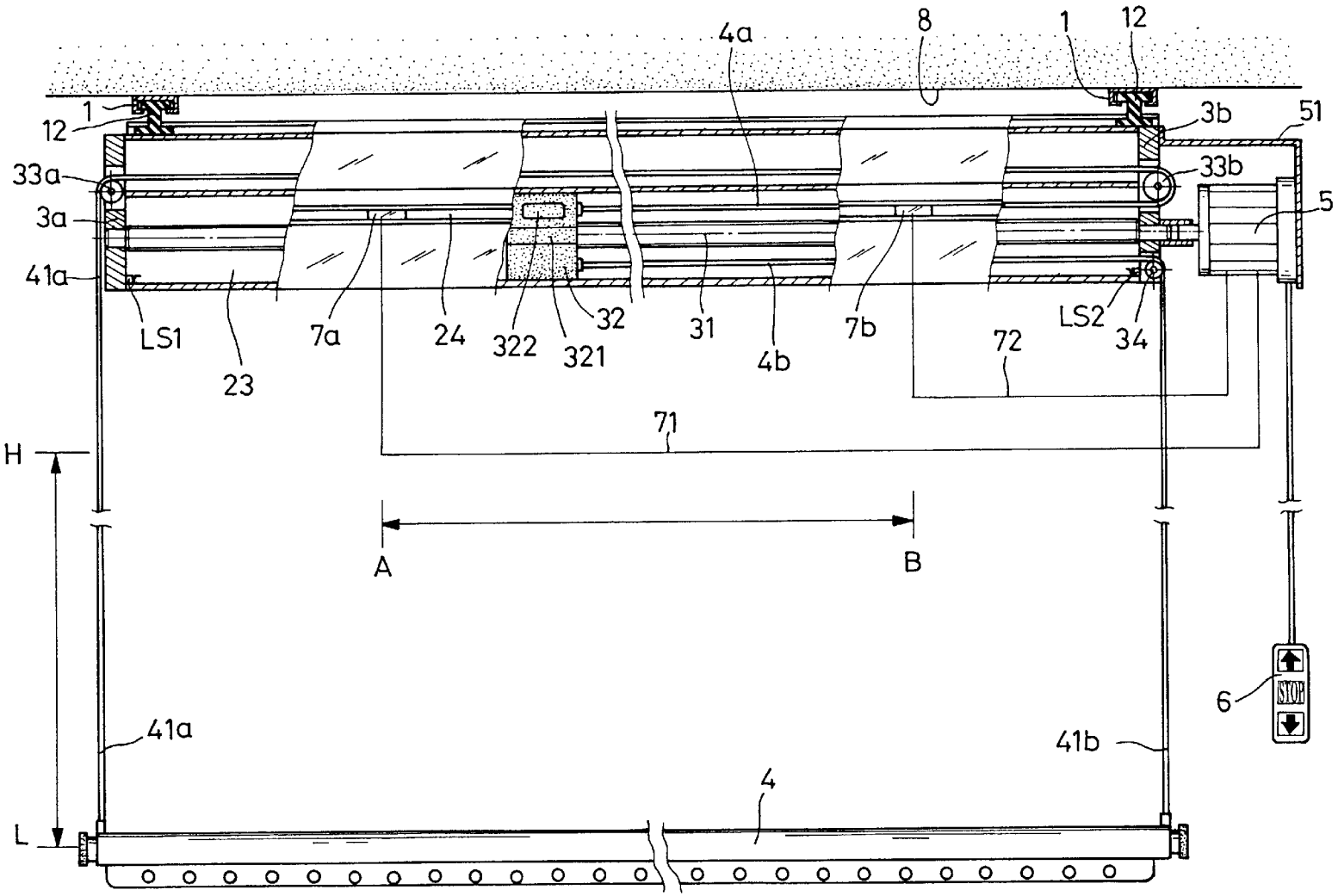
FIG. 6 is a schematic view of another embodiment of the present invention.

After installation, the user will generally determine the highest and lowest points of elevation of the clothes rod according to the space of the verandah or balcony. Hence, the present invention provides another embodiment. With reference to FIGS. 1, 4, and 6, an insert groove 24 is formed at an outer wall of the cylindrical tube 23. Two magnetic switches 7*a* and 7*b* are respectively fitted into the insert groove 24 and connected to the motor 5 by wires 71 and 72. On the other hand, the screw sleeve 32 is insertably provided with a magnet 322 at a position corresponding to the insert groove 24. The magnetic switches 7*a* and 7*b* are capable of slidable displacement along the insert groove for adjustment of control points. When the screw sleeve 32 displaces to the left to the magnetic switch 7*a* at a predetermined position A, the magnet 322 will attract the magnetic switch 7*a* so that the latter becomes "off". At this point, the motor 5 stops rotation. Likewise, when the screw sleeve 32 displaces to the right to the magnetic switch 7*b* at a predetermined position B, the motor 5 will also stop. The travel between positions A and B is the distance between H and L, which the clothes rod 4 may cover. The user may adjust the positions of the magnetic switches to set an appropriate distance of travel for the clothes rod 4. Even if the magnetic switches 7*a* and 7*b* do not function properly, the micro-switches LS1 and LS2 at both ends of the securing rod 2 will cause the motor 5 to stop when the screw sleeve 32 reaches a critical position to thereby ensure safety.

Furthermore, as the screw sleeve 32 is driven by the screw rod, the pulling force is very large. Besides, as the directions of the left and right ropes 4*a* and 4*b* are respectively controlled by means of the pulleys 33*a*, 33*b* and the lower pulley 34, the motor 5 may easily drive the screw rod 31 to cause to clothes rod 4 to elevate or drop. After reaching a determined point, the mechanical force generated by the screw rod 31 and the screw sleeve 32 will stabilize and position the clothes rod 4. Therefore, so long as the motor and the screw rod 31 do not rotate, the clothes rod 4 will not slip. Compared to manually operated clothes drying assemblies, in which a large force is required in order to elevate the clothes rod and the ropes may easily get entangled, or the clothes rod may even slip, the present invention is safe and very convenient to use.

Although the present invention has been illustrated and described with reference to the preferred embodiment thereof, it should be understood that it is in no way limited to the details of such embodiment but is capable of numerous modifications within the scope of the appended claims.

What is claimed is:

1. An electrically operated elevatable clothes drying assembly, comprising:

two positioning frames, locked to a ceiling or a framework and being provided with respective slide grooves for receiving upper flanges at upper ends of respective I-shaped positioning slide blocks;

a securing rod, including a slide groove formed at an upper end for receiving lower flanges at lower ends of said positioning slide blocks, a hollow extension extending downwardly from said slide groove, and a cylindrical tube formed at a lower end thereof, said cylindrical tube being provided with a pair of positioning lugs at its inner edges;

left and right covers, locked to the left and right ends of said securing rod respectively, a screw rod being positioned in said cylindrical tube by means of a screw sleeve having a pair of curved indentations matching said lugs of said cylindrical tube, said covers being further provided with respectively pulleys to correspond to said hollow extension, said left cover additionally having a lower pulley at a lower end thereof;

a clothes rod, including a left rope having an upper end wound around said pulleys of said left and right covers before being fixed at an upper end of said screw sleeve, and a right rope passing over said lower pulley before being secured at a lower end of said screw sleeve;

a motor, locked to one side of said right cover by means of a securing plate and being connected to said screw rod for driving said screw rod to rotate; and a control switch, for controlling the positive and reverse rotation of said motor as well as the start and stop of said motor.

2. An electrically operated elevatable clothes drying assembly as defined in claim 1, wherein said cylindrical tube of said securing rod is provided with micro-switches at both ends for controlling limit positions of said screw sleeve.

3. An electrically operated elevatable clothes drying assembly as defined in claim 1, wherein said cylindrical tube of said securing rod is further provided with an insert groove at an outer side thereof, said insert groove having two magnetic switches insertably disposed therein, said magnetic switches being connected to said motor by wires, and said screw sleeve being provided with a magnet corresponding to the position of said insert groove.

* * * * *